US012612837B2

(12) United States Patent
Zhang et al.

(10) Patent No.: US 12,612,837 B2
(45) Date of Patent: Apr. 28, 2026

(54) INFLATABLE ACTIVE PACKER

(71) Applicant: Xi'an Sunward Aeromat Co., Ltd., Xi'an (CN)

(72) Inventors: Gui Zhang, Xi'an (CN); Heng Zhang, Xi'an (CN); Changqing Ye, Xi'an (CN); Xueyuan Jiang, Xi'an (CN); Wei Yuan, Xi'an (CN); Bingchen Cuan, Xi'an (CN); Yuzhuo Xing, Xi'an (CN)

(73) Assignee: XI'AN SUNWARD AEROMAT CO., LTD., Xi'an (CN)

( * ) Notice: Subject to any disclaimer, the term of this patent is extended or adjusted under 35 U.S.C. 154(b) by 163 days.

(21) Appl. No.: 18/396,630

(22) Filed: Dec. 26, 2023

(65) Prior Publication Data

US 2024/0125073 A1 Apr. 18, 2024

Related U.S. Application Data

(63) Continuation-in-part of application No. PCT/CN2022/136184, filed on Dec. 2, 2022.

(30) Foreign Application Priority Data

May 11, 2022 (CN) ..... 202210510215.2

(51) Int. Cl.
*E21B 33/127* (2006.01)
*E21B 23/06* (2006.01)
*E21B 33/13* (2006.01)

(52) U.S. Cl.
CPC ..... *E21B 33/127* (2013.01); *E21B 23/06* (2013.01); *E21B 33/13* (2013.01)

(58) Field of Classification Search
CPC ..... E21B 33/127; E21B 33/13; E21B 23/06
See application file for complete search history.

(56) References Cited

U.S. PATENT DOCUMENTS 3,468,132 A * 9/1969 Harris ..... E02B 17/0008 405/211
4,047,391 A * 9/1977 Mayfield ..... E21B 33/127 405/225
4,399,869 A * 8/1983 Bentley ..... E21B 33/08 175/84
4,772,158 A * 9/1988 Coone ..... E02B 17/0008 405/195.1
4,968,184 A * 11/1990 Reid ..... E02B 17/0008 405/195.1

* cited by examiner

*Primary Examiner* — Nicole Coy
*Assistant Examiner* — Nicholas D Wlodarski
(74) *Attorney, Agent, or Firm* — MATTHIAS SCHOLL P.C.; Matthias Scholl

(57) ABSTRACT

An inflatable active packer includes: an inner steel pile; and a sleeve coaxially disposed outside the inner steel pile. The inner diameter of the sleeve is larger than the outer diameter of the inner steel pile. The length of the sleeve is less than or equal to the length of the inner steel pile. The sleeve includes an inner wall, and one end of the inner wall is provided with a guide lug. A strengthened clamping layer is attached to the inner wall of the sleeve. A rubber capsule is fixedly disposed in the middle of the strengthened clamping layer; two ends of the strengthened clamping layer are fixedly connected to the sleeve through a compression member. A mounting hole is disposed in the middle of the strengthened clamping layer. The sleeve includes a through hole coaxially with the mounting hole.

9 Claims, 4 Drawing Sheets

INFLATABLE ACTIVE PACKER

CROSS-REFERENCE TO RELATED APPLICATIONS

This application is a continuation-in-part of International Patent Application No. PCT/CN2022/136184 with an international filing date of Dec. 2, 2022, designating the United States, now pending, and further claims foreign priority benefits to Chinese Patent Application No. 202210510215.2 filed May 11, 2022. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to a packer for fixed offshore platforms, and more particularly to an inflatable active packer.

Conventional fixed offshore platforms include a working platform and a jacket located below the waterline at the bottom of the working platform. The jacket is fixed through the connection between a sleeve mounted on the bottom of the main leg of the jacket and an inner steel pile disposed through the sleeve and extending into the seabed. The outer diameter of the inner steel pile is smaller than the inner diameter of the sleeve. The fixing between the sleeve and the inner steel pile is achieved by pouring cement grout. However, direct grouting in the annular space will be contaminated by seabed sludge and the cement slurry tends to overflow, leading to failure of the solidification and fixation. Therefore, it is necessary to dispose a packer in the lower part of the annular space between the sleeve and the inner steel pile to preclude the seabed sludge and the cement slurry from flowing into the annular space.

At present, underwater packers used on fixed offshore platforms include active packers and passive packers according to their working types. Passive packers are only suitable for shallow water areas. In the pile driving process, the rapid falling of the inner steel piles tends to destroy the packer. The application of the passive packers in deep-sea areas is limited, and their working must be accompanied by hydraulic pipelines, power stations, and emergency interfaces for underwater robots. This leads to complex operations, large debugging workload, and high costs.

SUMMARY

To solve the conventional problem that, in the pile driving process, the rapid falling of the inner steel piles tends to destroy the packer, the disclosure provides an inflatable active packer.

In accordance with one embodiment of the disclosure, the disclosure provides an inflatable active packer, comprising: an inner steel pile being cylindrical; and a sleeve coaxially disposed outside the inner steel pile. The inner diameter of the sleeve is larger than an outer diameter of the inner steel pile; a length of the sleeve is less than or equal to a length of the inner steel pile; the sleeve comprises an inner wall, and one end of the inner wall is provided with a guide lug; a strengthened clamping layer is attached to the inner wall of the sleeve; a rubber capsule is fixedly disposed in a middle of the strengthened clamping layer; two ends of the strengthened clamping layer are fixedly connected to the sleeve through a compression member; a mounting hole is disposed in the middle of the strengthened clamping layer; the sleeve comprises a through hole coaxially with the mounting hole, and the through hole has the same diameter as the mounting hole; a charging nozzle is disposed in the mounting hole, and the charging nozzle is disposed through the sleeve and the strengthened clamping layer, and into the rubber capsule.

In a class of this embodiment, the compression member is a concave assembly comprising a recessed pressing plate, a first gasket, and a fastening bolt; the two ends of the strengthened clamping layer each comprise a protruding buckle; the strengthened clamping layer is clamped in the recessed pressing plate; the recessed pressing plate is connected to the sleeve through the fastening bolt; and the first gasket is disposed between the recessed pressing plate and the sleeve.

In a class of this embodiment, the two ends of the strengthened clamping layer each are a straight bar; the compression member is an L-shaped assembly comprising an L-shaped pressing plate, a second gasket, and a fastening bolt; the strengthened clamping layer abuts against the L-shaped pressing plate; the L-shaped pressing plate is connected to the sleeve through the fastening bolt; and the second gasket is disposed between the L-shaped pressing plate and the sleeve.

In a class of this embodiment, the charging nozzle is a threaded structure; a valve block is in threaded connection to a part of the charging nozzle exposed out of the sleeve; the valve block comprises a first axial end abutting against the sleeve, and a second axial end abutting against a tight nut; the tight nut is in threaded connection to the charging nozzle; the valve block comprises a unidirectional air passage; the unidirectional air passage is disposed through the valve block and an air passage of the charging nozzle; a valve is fixedly disposed on both an inlet end and an outlet end of the unidirectional air passage; one end of the valve away from the unidirectional air passage is fixedly connected to an inflating flexible tube, and one end of the inflating flexible tube away from the unidirectional air passage is connected to an air source.

In a class of this embodiment, two seal grooves are respectively disposed on the inner wall and outer wall of the sleeve; the two seal grooves are coaxial with the charging nozzle; each of the two seal grooves is provided with a sealing gasket, and the sealing gasket sleeves the charging nozzle.

In a class of this embodiment, the strengthened clamping layer and the rubber capsule comprise one or more layers of cloth rubber.

In a class of this embodiment, a thickness of the compression member is not greater than that of the guide lug.

In a class of this embodiment, when the rubber capsule is unfilled with a filler, a total thickness of the strengthened clamping layer and the rubber capsule is not greater than that of the guide lug.

In a class of this embodiment, the filler is gas or liquid.

In a class of this embodiment, a top end of the guide lug is inclined downwards from the inner wall of the sleeve to an axis of the sleeve.

The following advantages are associated with the inflatable active packer of the disclosure.

1. The inflatable active packer comprises the rubber capsule, the strengthened clamping layer and the charging nozzle, and the rubber capsule and the strengthened clamping layer are made of cloth rubber. The cloth rubber greatly ensures the pressure resistance of the rubber capsule, ensuring that the rubber capsule will not rupture, the air will not leak, and the liquid will not seep during the air or liquid filling process. At the same time, the cloth rubber improves the overall rigidity of the rubber capsule, effectively avoiding the problem of easy damage to the packer.

2. The inflatable active packer has ingenious structural design, simple working principle, is easy to operate, and can provide a support force greater than the gravity of the cement slurry itself, with good sealing performance, which is more conducive to application in deep sea.

Figure 1:
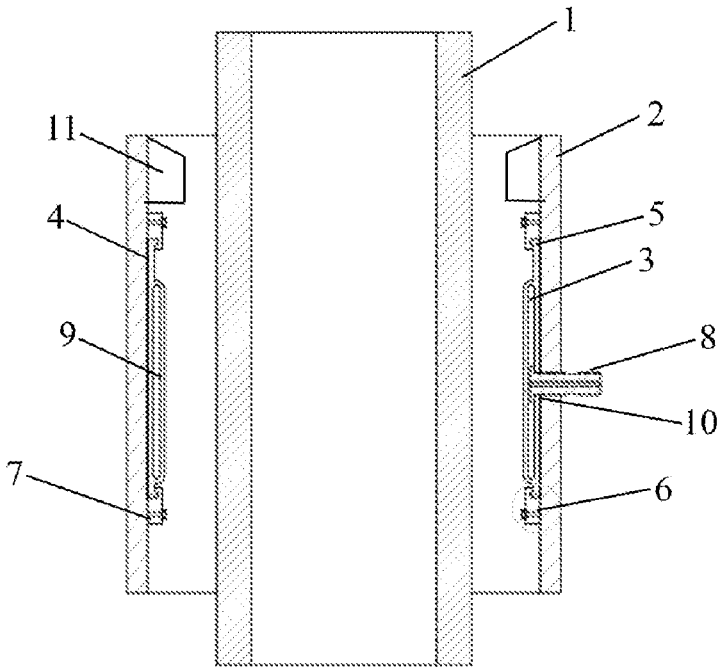
FIG. 1 is a schematic diagram of an inflatable active packer according to Example 1 of the disclosure.

In the drawings, the following reference numbers are used: 1. Inner steel pile; 2. Sleeve; 3. Filler; 4. High strength clamping layer; 5. Protruding buckle; 6. Concave assembly; 7. Fastening bolt ; 8. Charging nozzle; 9. Rubber capsule; 10. Mounting hole; 11. Guide lug; 12. Valve block; 13. Valve; 14. Tight nut; 15. Unidirectional air passage; 16. Seal groove; 17. L-shaped assembly; 18. Straight bar; 19. First gasket; 20. Recessed pressing plate; 21. L-shaped pressing plate; 22. Second gasket.

DETAILED DESCRIPTION

To further illustrate the disclosure, embodiments detailing an inflatable active packer are described below. It should be noted that the following embodiments are intended to describe and not to limit the disclosure.

EXAMPLE 1

As shown in FIG. 1, the disclosure provides an inflatable active packer comprising an inner steel pile 1 being cylindrical and a sleeve 2 coaxially disposed outside the inner steel pile 1. The inner diameter of the sleeve 2 is larger than the outer diameter of the inner steel pile 1. The length of the sleeve 2 is less than or equal to the length of the inner steel pile 1. The sleeve 2 comprises an inner wall, and one end of the inner wall is provided with a guide lug 11. The top end of the guide lug 11 is inclined downwards from the inner wall of the sleeve to the axis of the sleeve 2. A strengthened clamping layer 4 is attached to the inner wall of the sleeve 2. A rubber capsule 9 is fixedly disposed in the middle of the strengthened clamping layer 4; two ends of the strengthened clamping layer 4 are fixedly connected to the sleeve 2 through a compression member; a mounting hole 10 is disposed in the middle of the strengthened clamping layer 4; the sleeve 2 comprises a through hole coaxially with the mounting hole 10, and the through hole has the same diameter as the mounting hole; a charging nozzle 8 is disposed in the mounting hole 10, and the charging nozzle 8 is disposed through the sleeve 2 and the strengthened clamping layer 4, and into the rubber capsule 9. The strengthened clamping layer 4 and the rubber capsule 9 comprise one or more layers of cloth rubber, with strong overall pressure resistance and excellent airtightness, which can prevent gas or liquid leakage. The cloth rubber greatly ensures the pressure resistance of the rubber capsule 9, ensuring that the rubber capsule 9 will not rupture, the air will not leak, and the liquid will not seep during the air or liquid filling process. At the same time, the cloth rubber improves the overall rigidity of the rubber capsule 9, effectively avoiding the problem of easy damage to the packer. The thickness of the compression member is not greater than that of the guide lug 11, which can avoid damage during the pile driving process. When the rubber capsule 9 is unfilled with a filler 3, a total thickness of the strengthened clamping layer 4 and the rubber capsule 9 is not greater than that of the guide lug 11. The filler 3 is gas or liquid.

Figure 2:
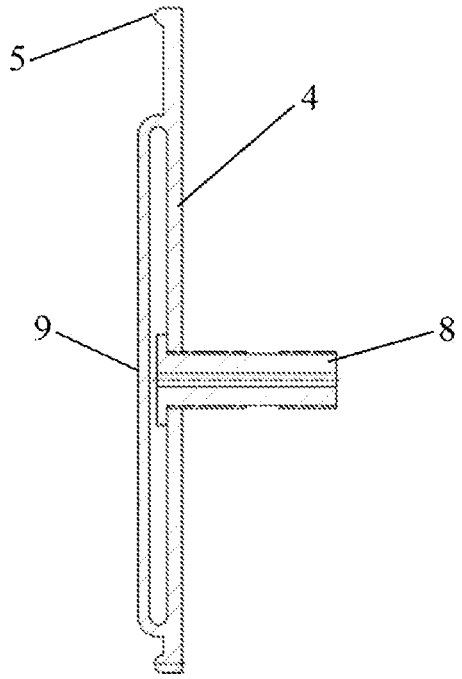
FIG. 2 is a schematic diagram of a rubber capsule according to one embodiment of the disclosure.
Figure 3:
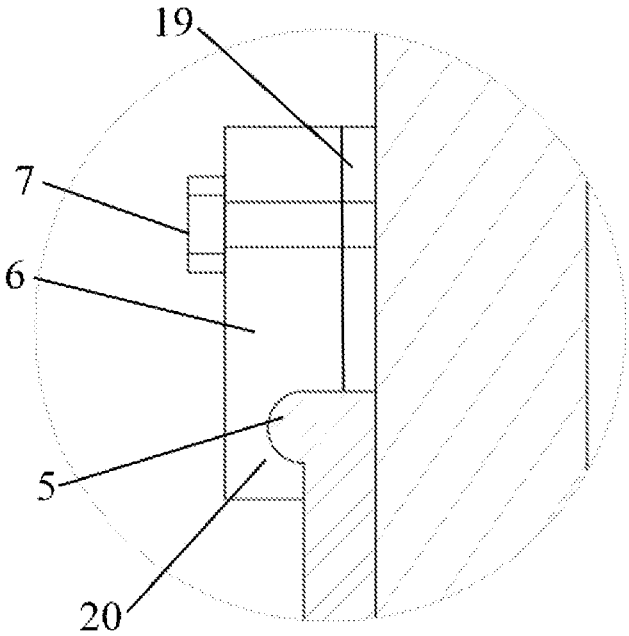
FIG. 3 is a schematic diagram of a concave assembly according to one embodiment of the disclosure.

As shown in FIGS. 2-3, the compression member is a concave assembly 6 comprising a recessed pressing plate 20, a first gasket 19, and a fastening bolt 7; the two ends of the strengthened clamping layer 4 each comprise a protruding buckle 5; the strengthened clamping layer 4 is clamped in the recessed pressing plate 20; the recessed pressing plate 20 is connected to the sleeve 2 through the fastening bolt 7; and the first gasket 19 is disposed between the recessed pressing plate 20 and the sleeve 2.

Figure 4:
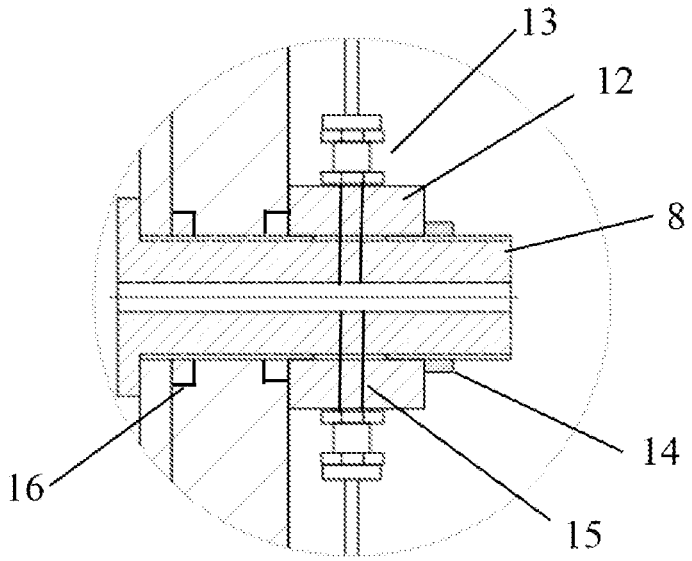
FIG. 4 is a schematic diagram of a charging nozzle according to one embodiment of the disclosure.
Figure 5:
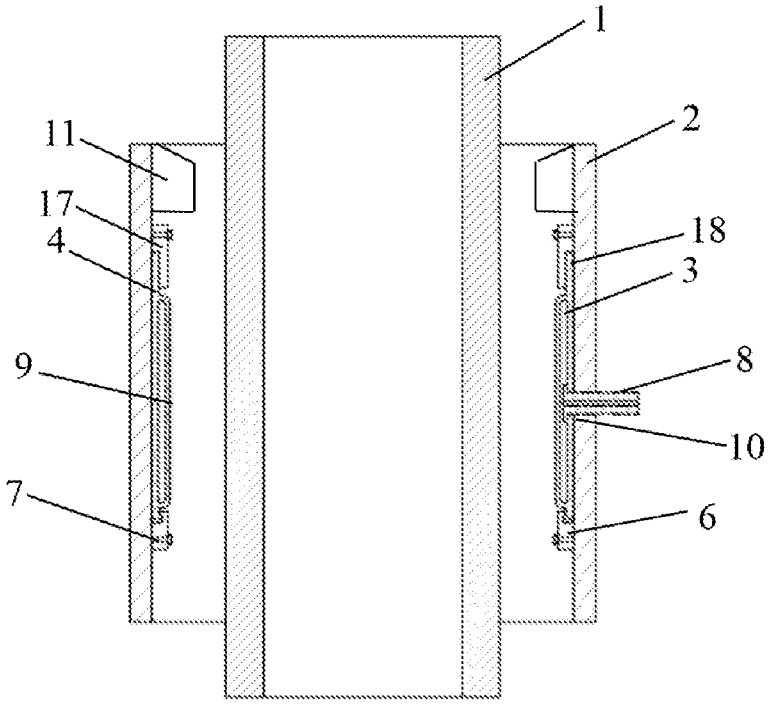
FIG. 5 is a schematic diagram of an inflatable active packer according to Example 2 of the disclosure.

As shown in FIG. 4, the charging nozzle 8 is a threaded structure; a valve block 12 is in threaded connection to a part of the charging nozzle 8 exposed out of the sleeve 2; the valve block 12 comprises a first axial end abutting against the sleeve 2, and a second axial end abutting against a tight nut 14; the tight nut 14 is in threaded connection to the charging nozzle 8; the valve block 12 comprises a unidirectional air passage 15; the unidirectional air passage 15 is disposed through the valve block 12 and an air passage of the charging nozzle 8; a valve 13 is fixedly disposed on both an inlet end and an outlet end of the unidirectional air passage 15; one end of the valve 13 away from the unidirectional air passage 15 is fixedly connected to an inflating flexible tube, and one end of the inflating flexible tube away from the unidirectional air passage 15 is connected to an air source.

Two seal grooves 16 are respectively disposed on the inner wall and outer wall of the sleeve 2; the two seal grooves 16 are coaxial with the charging nozzle 8; each of the two seal grooves 16 is provided with a sealing gasket, and the sealing gasket sleeves the charging nozzle 8.

EXAMPLE 2

As shown in FIG. 1, the disclosure provides an inflatable active packer comprising an inner steel pile 1 being cylindrical and a sleeve 2 coaxially disposed outside the inner steel pile 1. The inner diameter of the sleeve 2 is larger than the outer diameter of the inner steel pile 1. The length of the sleeve 2 is less than or equal to the length of the inner steel pile 1. The sleeve 2 comprises an inner wall, and one end of the inner wall is provided with a guide lug 11. The top end of the guide lug 11 is inclined downwards from the inner wall of the sleeve to the axis of the sleeve 2. A strengthened clamping layer 4 is attached to the inner wall of the sleeve 2. A rubber capsule 9 is fixedly disposed in the middle of the strengthened clamping layer 4; two ends of the strengthened clamping layer 4 are fixedly connected to the sleeve 2 through a compression member; a mounting hole 10 is disposed in the middle of the strengthened clamping layer 4; the sleeve 2 comprises a through hole coaxially with the mounting hole 10, and the through hole has the same diameter as the mounting hole; a charging nozzle 8 is disposed in the mounting hole 10, and the charging nozzle 8 is disposed through the sleeve 2 and the strengthened clamping layer 4, and into the rubber capsule 9. The strengthened clamping layer 4 and the rubber capsule 9 comprise one or more layers of cloth rubber, with strong overall pressure resistance and excellent airtightness, which can prevent gas or liquid leakage. The cloth rubber greatly ensures the pressure resistance of the rubber capsule 9, ensuring that the rubber capsule 9 will not rupture, the air will not leak, and the liquid will not seep during the air or liquid filling process. At the same time, the cloth rubber improves the overall rigidity of the rubber capsule 9, effectively avoiding the problem of easy damage to the packer. The thickness of the compression member is not greater than that of the guide lug 11, which can avoid damage during the pile driving process. When the rubber capsule 9 is unfilled with a filler 3, a total thickness of the strengthened clamping layer 4 and the rubber capsule 9 is not greater than that of the guide lug 11. The filler 3 is gas or liquid.

Figure 6:
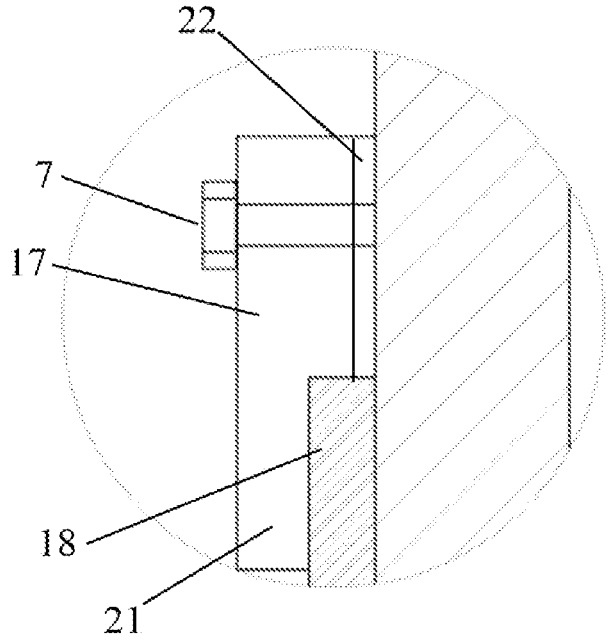
FIG. 6 is a schematic diagram of an L-shaped pressing plate according to one embodiment of the disclosure.

As shown in FIG. 6, the two ends of the strengthened clamping layer 4 each are a straight bar 18; the compression member is an L-shaped assembly 17 comprising an L-shaped pressing plate 21, a second gasket 22, and a fastening bolt 7; the strengthened clamping layer 4 abuts against the L-shaped pressing plate 21; the L-shaped pressing plate 21 is connected to the sleeve 2 through the fastening bolt 7; and the second gasket 22 is disposed between the L-shaped pressing plate 21 and the sleeve 2.

Figure 7:
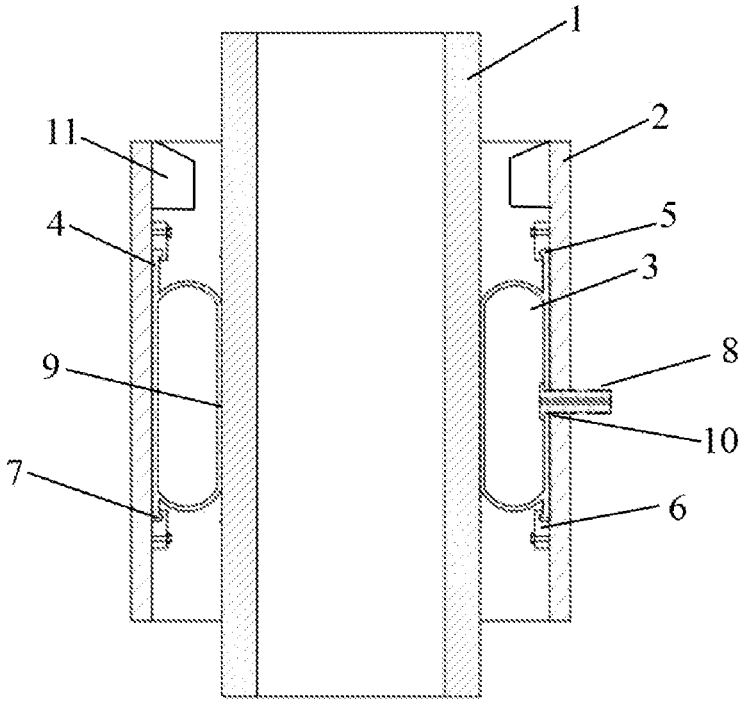
FIG. 7 is a schematic diagram of a rubber capsule in an expanded state according to one embodiment of the disclosure.

The working principle of the inflatable active packer of the disclosure is as follows: the strengthened clamping layer 4 together with the rubber capsule 9 are fixed on the inner wall of the sleeve 2, and the overall thickness of the rubber capsule 9 and the strengthened clamping layer 4 does not exceed the thickness of the guide lug 11 when the rubber capsule 9 is not filled with the gas or the liquid, so as to avoid the destruction of the packer in the process of piling. As shown in FIG. 7, a certain amount of gas or liquid is filled into the rubber capsule 9 through the charging nozzle 8 to induce the rubber capsule 9 to expand, and the expanded rubber capsule 9 seals the annular space between the sleeve 2 and the inner steel pile 1. The annular space can then be injected with cementitious slurry, and along with the increase of the internal pressure of the rubber capsule 9, the squeezing force between the rubber capsule 9 and the inner steel pile 1 is also increasing, which is sufficient to bear the gravity of the cementitious slurry as a whole. The special rubber structure of the strengthened clamping layer 4 and its vertical tensile strength are sufficient to support the gravity of the cement slurry because the two ends of the strengthened clamping layer are fixed by the compression member.

It will be obvious to those skilled in the art that changes and modifications may be made, and therefore, the aim in the appended claims is to cover all such changes and modifications.

What is claimed is:

1. An inflatable active packer, comprising:

an inner steel pile of a cylindrical shape;

a sleeve of a cylindrical shape and coaxially disposed outside the inner steel pile; the sleeve comprising an inner cylindrical wall;

a cylindrical clamping layer;

a rubber capsule;

a plurality of assemblies; and a charging nozzle;

wherein:

an inner diameter of the sleeve is larger than an outer diameter of the inner steel pile;

a length of the sleeve is less than or equal to a length of the inner steel pile;

one end of the inner cylindrical wall of the sleeve is provided with a guide lug;

the cylindrical clamping layer is attached to the inner cylindrical wall of the sleeve;

the rubber capsule comprises the cylindrical clamping layer and a bulgy portion; the bulgy portion extends from a middle portion of the cylindrical clamping layer towards the inner steel pile; wherein an annular space is enclosed by the bulgy portion and the cylindrical clamping layer;

two ends of the cylindrical clamping layer are fixedly connected to the sleeve through the plurality of assemblies:

a mounting hole is disposed in a middle position of the cylindrical clamping layer;

the sleeve comprises a through hole coaxially with the mounting hole, and the through hole has the same diameter as the mounting hole; and the charging nozzle is disposed in the through hole and the mounting hole; and the charging nozzle is disposed through the sleeve and the cylindrical clamping layer, and into the rubber capsule;

each of the plurality of assemblies comprises a recessed pressing plate, a first gasket, and a fastening bolt;

the two ends of the cylindrical clamping layer each comprises a protruding buckle; each protruding buckle on the cylindrical clamping layer is clamped in the recessed pressing plate on one of the plurality of assemblies; and for one of the plurality of assemblies, the recessed pressing plate is connected to the sleeve through the fastening bolt, and the first gasket is disposed between the recessed pressing plate and the sleeve.

2. The packer of claim 1, wherein two seal grooves are respectively disposed on the inner wall and outer wall of the sleeve; the two seal grooves are coaxial with the charging nozzle; each of the two seal grooves is provided with a sealing gasket, and each sealing gasket sleeves the charging nozzle.

3. The packer of claim 1, wherein the cylindrical clamping layer and the bulgy portion of the rubber capsule comprise one or more layers of cloth rubber.

4. The packer of claim 1, wherein a thickness of each of the plurality of assemblies is not greater than that of the guide lug.

5. The packer of claim 1, wherein when the rubber capsule is unfilled with a filler, a total thickness of the rubber capsule is not greater than that of the guide lug.

6. The packer of claim 5, wherein the filler is gas or liquid.

7. The packer of claim 1, wherein a top end of the guide lug is inclined downwards from the inner wall of the sleeve to an axis of the sleeve.

8. An inflatable active packer, comprising:

an inner steel pile of a cylindrical shape;

a sleeve of a cylindrical shape and coaxially disposed outside the inner steel pile; the sleeve comprising an inner cylindrical wall;

a cylindrical clamping layer;

a rubber capsule;

a plurality of assemblies; and a charging nozzle;

wherein:

an inner diameter of the sleeve is larger than an outer diameter of the inner steel pile;

a length of the sleeve is less than or equal to a length of the inner steel pile;

one end of the inner cylindrical wall of the sleeve is provided with a guide lug;

the cylindrical clamping layer is attached to the inner cylindrical wall of the sleeve;

the rubber capsule comprises the cylindrical clamping layer and a bulgy portion; the bulgy portion extends from a middle portion of the cylindrical clamping layer towards the inner steel pile; wherein an annular space is enclosed by the bulgy portion and the cylindrical clamping layer;

two ends of the cylindrical clamping layer are fixedly connected to the sleeve through the plurality of assemblies;

a mounting hole is disposed in a middle position of the cylindrical clamping layer;

the sleeve comprises a through hole coaxially with the mounting hole, and the through hole has the same diameter as the mounting hole; and the charging nozzle is disposed in the through hole and the mounting hole; and the charging nozzle is disposed through the sleeve and the cylindrical clamping layer, and into the rubber capsule;

the two ends of the cylindrical clamping layer each comprises a straight bar;

each of the plurality of assemblies comprises an L-shaped pressing plate, a gasket, and a fastening bolt;

each straight bar on the cylindrical clamping layer abuts against the L-shaped pressing plate on one of the plurality of concave assemblies; and for one of the plurality of assemblies, the L-shaped pressing plate is connected to the sleeve through the fastening bolt, and the gasket is disposed between the L-shaped pressing plate and the sleeve.

9. An inflatable active packer, comprising:

an inner steel pile of a cylindrical shape;

a sleeve of a cylindrical shape and coaxially disposed outside the inner steel pile; the sleeve comprising an inner cylindrical wall;

a cylindrical clamping layer;

a rubber capsule;

a plurality of assemblies; and a charging nozzle;

wherein:

an inner diameter of the sleeve is larger than an outer diameter of the inner steel pile;

a length of the sleeve is less than or equal to a length of the inner steel pile;

one end of the inner cylindrical wall of the sleeve is provided with a guide lug;

the cylindrical clamping layer is attached to the inner cylindrical wall of the sleeve;

the rubber capsule comprises the cylindrical clamping layer and a bulgy portion; the bulgy portion extends from a middle portion of the cylindrical clamping layer towards the inner steel pile; wherein an annular space is enclosed by the bulgy portion and the cylindrical clamping layer;

two ends of the cylindrical clamping layer are fixedly connected to the sleeve through the plurality of assemblies;

a mounting hole is disposed in a middle position of the cylindrical clamping layer;

the sleeve comprises a through hole coaxially with the mounting hole, and the through hole has the same diameter as the mounting hole; and the charging nozzle is disposed in the through hole and the mounting hole; and the charging nozzle is disposed through the sleeve and the cylindrical clamping layer, and into the rubber capsule;

the charging nozzle is a threaded structure; a valve block is in threaded connection to a part of the charging nozzle exposed out of the sleeve; the valve block comprises a first axial end abutting against the sleeve, and a second axial end abutting against a tight nut; the tight nut is in threaded connection to the charging nozzle; the valve block comprises a unidirectional air passage; the unidirectional air passage is disposed through the valve block and an air passage of the charging nozzle; a valve is fixedly disposed on both an inlet end and an outlet end of the unidirectional air passage; one end of the valve away from the unidirectional air passage is fixedly connected to an inflating flexible tube, and one end of the inflating flexible tube away from the unidirectional air passage is connected to an air source.

* * * * *